US005821801A

United States Patent [19]

Kolb et al.

[11] Patent Number: 5,821,801

[45] Date of Patent: Oct. 13, 1998

[54] ELECTRICAL THERMOSTAT

[75] Inventors: Hans Kolb; Robert Sirotich; Alan Boyce, all of Calgary, Canada

[73] Assignee: Starozik Industires Ltd., Calgary, Canada

[21] Appl. No.: 580,929

[22] Filed: Dec. 29, 1995

[30] Foreign Application Priority Data

Jun. 13, 1994 [CA] Canada ..... 2151641

[51] Int. Cl.[6] ..... H01H 37/70

[52] U.S. Cl. ..... 337/348; 337/333; 337/368; 337/380

[58] Field of Search ..... 337/333, 365, 337/367, 348, 362, 368, 372, 380

[56] References Cited

U.S. PATENT DOCUMENTS

| | | | |
|---|---|---|---|
| 3,663,916 | 5/1972 | Beck | 337/396 |
| 3,878,498 | 4/1975 | Allen et al. | 337/368 X |
| 4,039,992 | 8/1977 | Givler | 337/365 |
| 4,495,481 | 1/1985 | Hickling et al. | 337/349 |

*Primary Examiner*—Leo P. Picard
*Assistant Examiner*—Jayprakash N. Gandhi
*Attorney, Agent, or Firm*—David J. French

[57] ABSTRACT

A thermostat uses a bimetal plate carried by a rotating knob. Adjustment of the knob to select the thermostat's temperature setting displaces the entire bimetal plate towards or away from the electrical switch being activated. The bimetal plate is contained between protrusions from the knob and the coupling to the electrical switch.

9 Claims, 3 Drawing Sheets

ELECTRICAL THERMOSTAT

FIELD OF THE INVENTION

This invention relates to thermostats. More particularly, it relates to electrical thermostats that operate on bimetal differential co-efficient of expansion.

BACKGROUND TO THE INVENTION

Many thermostats rely on the deformation with heating of a bimetal strip normally consisting of two metal plates, one with a high and one with a low coefficient of thermal expansion, bonded face to face to form a combined or bimetal plate. When the temperature of the combined plate changes, its curvature will change in response to the difference in the thermal expansion of the two metals. As the curvature of the strip changes, the centre of the plate will deflect relative to its ends. This deflection is harnessed in order to activate the plunger of an electrical switch.

In one type of contemporary thermostat construction, the bimetal plate is in the form of a rectangular length or strip of bimetal that is mounted as a lever pivoting about a fixed support at one end that serves as a fulcrum. The centre of this strip is in contact, directly or indirectly as through a calibration or adjustment screw and, in some cases, an additional thrust transfer pin, with the plunger of an electrical switch. The linkages between the bimetal strip and the switch constitute in the most general sense a switch coupling means.

The temperature at which thermostatic tripping action of the switch occurs, the "set" temperature, is adjusted by changing the relative location of the central, active region of the strip with respect to the switch plunger. To achieve this, it has been provided that the position of the far end of the strip opposite its fulcrum, and thereby its centre, is adjusted by turning a cammed surface coupled to a knob. This causes the bimetal strip to rotate about its fulcrum. Because the plate is fixed at one end, the angle of the bimetal strip to the thrust transfer pin is altered by the adjustment action of rotating the cammed surface.

In the conventional construction because the bimetal strip is not always normal to the axis of the plunger of the switch (or thrust transfer pin, if present), some of the strip's mechanical action will be wasted.

Further, because the bimetal strip is pivoting about one end, the relative position of the calibration screw on the thrust transfer pin will change as will its angle to the pin. This will result in a relative motion between the calibration screw and the end of the pin with changes in temperature. Thus, as the bimetal strip bows, the end of the calibration screw will tend to slide on the surface of the plunger or thrust transfer pin.

In some fixed or non-adjustable thermostats, the angle of the line tangent to the center of the bimetal sensing element and the axis of the switch plunger remains constant. However, this feature is not known to be present in an adjustable thermostat.

It would be desirable to provide an adjustable thermostat wherein a bimetal plate is provided, having a center of maximum action of the bimetal plate which remains in a constant angular relationship to the switch plunger or thrust transfer pin.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention, an electrical thermostat is provided with a bimetal plate that is contained between peripheral supports on one side of the plate, and a centrally positioned switch coupling means on the other side that operates an electrical switch. The switch coupling means may be an actual plunger on a switch or may include a thrust transfer pin that contacts such a plunger.

According to one feature of the invention, the peripheral supports that help contain the bimetal plate are mounted on a threaded bearing for advancement of the bimetal plate along the axis of the switch coupling means. Preferably, the bimetal plate and peripheral supports are carried within a rotatable knob that may be turned by a user to adjust the set-point of the thermostat.

Also preferably, the supports comprise pointed or wedge-shaped protrusions that contact the bimetal plate at three separated points, or along three separate lines of contact, located near the outer periphery of the bimetal plate. The points or lines of contact between the protrusions and the bimetal plate are intended to permit differential motion between these parts in the plane of the plate, the bimetal plate being stabilized by being simply contained between the protrusions on one side, and the switch coupling means on the opposite side.

An adjustment means to permit calibration of the thermostat may be provided in the form of a threaded adjustment screw that is threadably engaged to the bimetal plate. This engagement is preferably effected at the point where maximum deflection occurs. The adjustment screw bears upon the switch coupling means which activates the switch. Rotation of the adjustment screw within the bimetal plate therefore displaces the switch coupling means relative to the bimetal plate, allowing the degree of displacement of the bimetal plate needed to activate the switch to be varied. This, therefore, allows the thermostat to be calibrated to ensure that its set point coincides with a temperature scale carried by the knob.

Optionally, the adjustment screw penetrates into a recess in a thrust pin, preferably cylindrical in shape, maintaining these two components in axial alignment. This, therefore, maintains the center of the bimetal plate in axial alignment with the thrust pin in the case where the supports on the other side of the plate are only in point or simple line contact with the plate.

The mode of support provided by the invention ensures that the contact between the adjustment screw and switch coupling means is effected with virtually no transverse motion occurring with changes in temperature.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
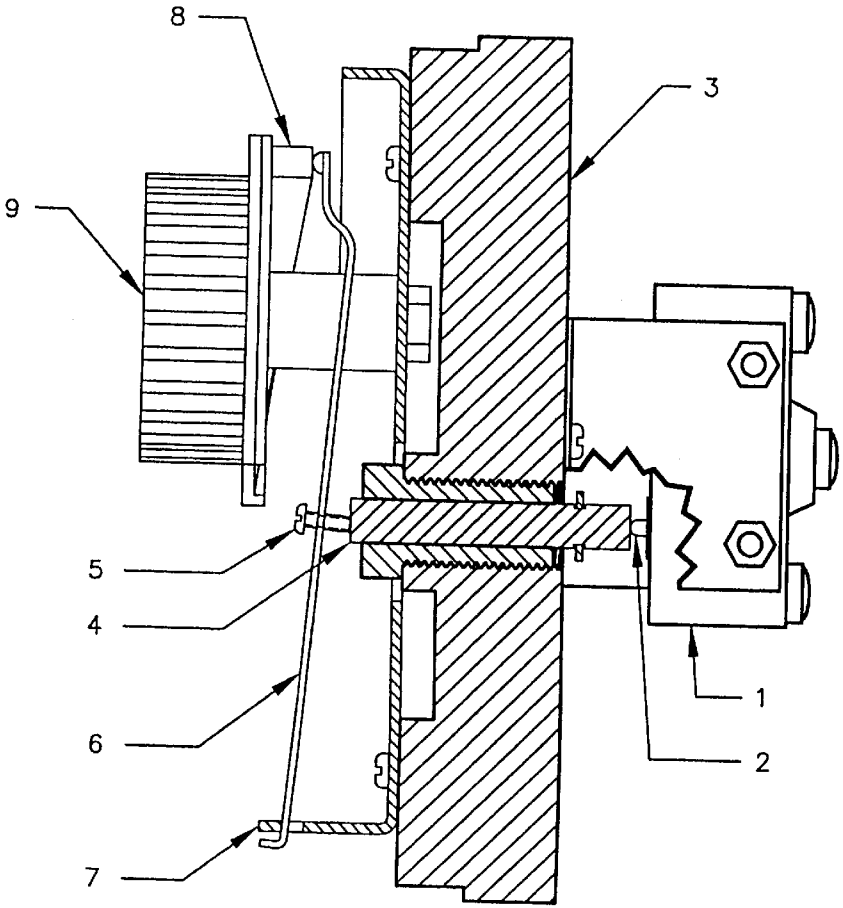
FIGURE 1 PRIOR ART
FIG. 1 is a partially cross-sectional side view of a conventional bimetal type of thermostat.
Figure 3:
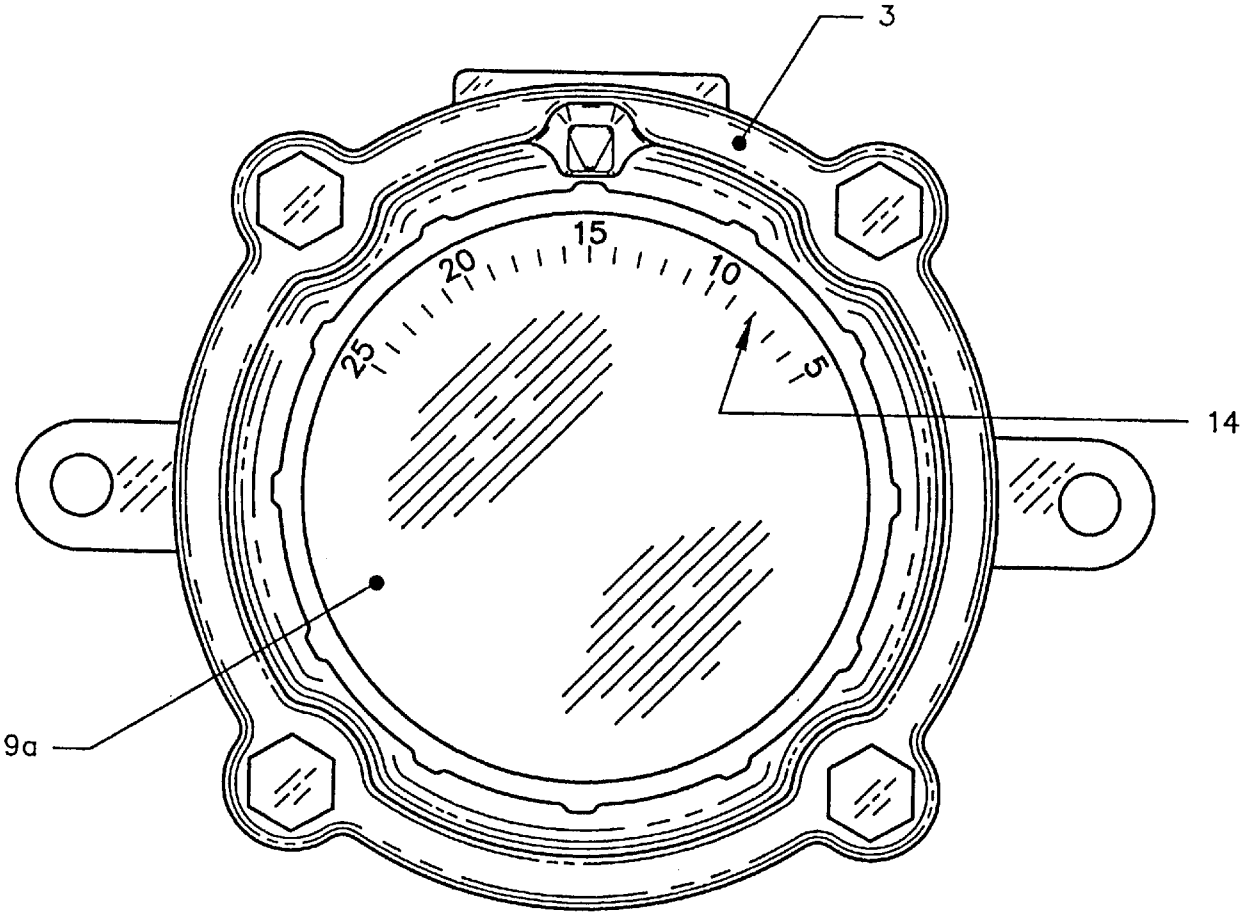
FIG. 3 is a front view from the knob side of the thermostat of FIG. 2.

In FIG. 1 a conventional thermostat has a switch 1 with switch plunger 2 connected to a thermostat body 3. This body 3 carries a sliding thrust pin 4 that bears against the switch plunger 2 at one end, and is contacted at its other end by an adjustment or calibration screw 5 carried by a rectangular bimetal strip 6. The thrust pin 4 and switch plunger 2 constitute switch coupling means for transferring thrust from the bimetal strip 6 to the switch 1. The presence of a thrust transfer pin 4 is optional, and in its absence the plunger 2 acts as the switch coupling means.

One end of the bimetal strip 6 is in contact with a post 7 extending from the body 3. The other end of the strip 6 bears against a circularly ramped, camming surface 8 carried by a rotatable knob 9. The knob 9, in turn, is supported by the body 3.

A change in temperature causes the bimetal strip 6 to displace the adjustment screw 5 and, through the thrust pin 4, cause movement of the switch plunger 2. Rotation of the knob 9 causes the end of the bimetal strip 6 contacting the camming surface 8 to be displaced, causing the bimetal strip 6 to swing in an arc about its opposite end. This causes the adjustment screw 5 to tend to slide across the end of the thrust pin 4, changing its point of contact. As the knob 9 is turned, the angular orientation of the adjustment screw 5 to the end of the thrust pin 4 also varies.

As the direction of displacement of the adjustment screw 5 in response to the thermal distortion of the bimetal strip 6 is generally in the direction of the adjustment screw 5, such displacement is not precisely aligned with the axis of the thrust pin 4. Further, the degree of misalignment varies with the setting of the adjustment screw 5 and knob 9.

Figure 2:
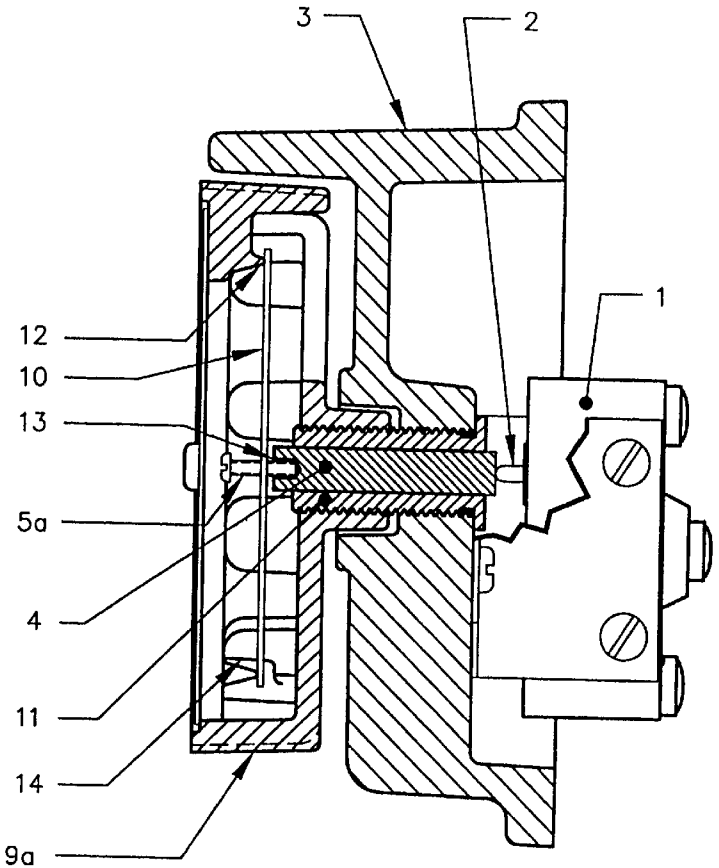
FIG. 2 is a partially cross-sectional side view of a thermostat according to the invention.

In FIG. 2 the bimetal strip 6 of FIG. 1 has been replaced by a generally rectangular or square bimetal plate 10 (other shapes being permissible). This plate 10 is contained within a knob 9*a* that rotates about the axis of the thrust pin 4, carried by threads 11.

The plate 10 is supported on one side around its periphery by three protrusions 12 extending from the knob 9*a* in separated locations. On the other side, the plate 10 is supported by the adjustment screw 5*a* that extends into a centrally-aligned cylindrical recess 13 in the end of the thrust pin 4. The plate 10 may also be caged by flanking protrusions 14 to prevent excessive differential rotation between the plate 10 and knob 9*a*.

Figure 4:
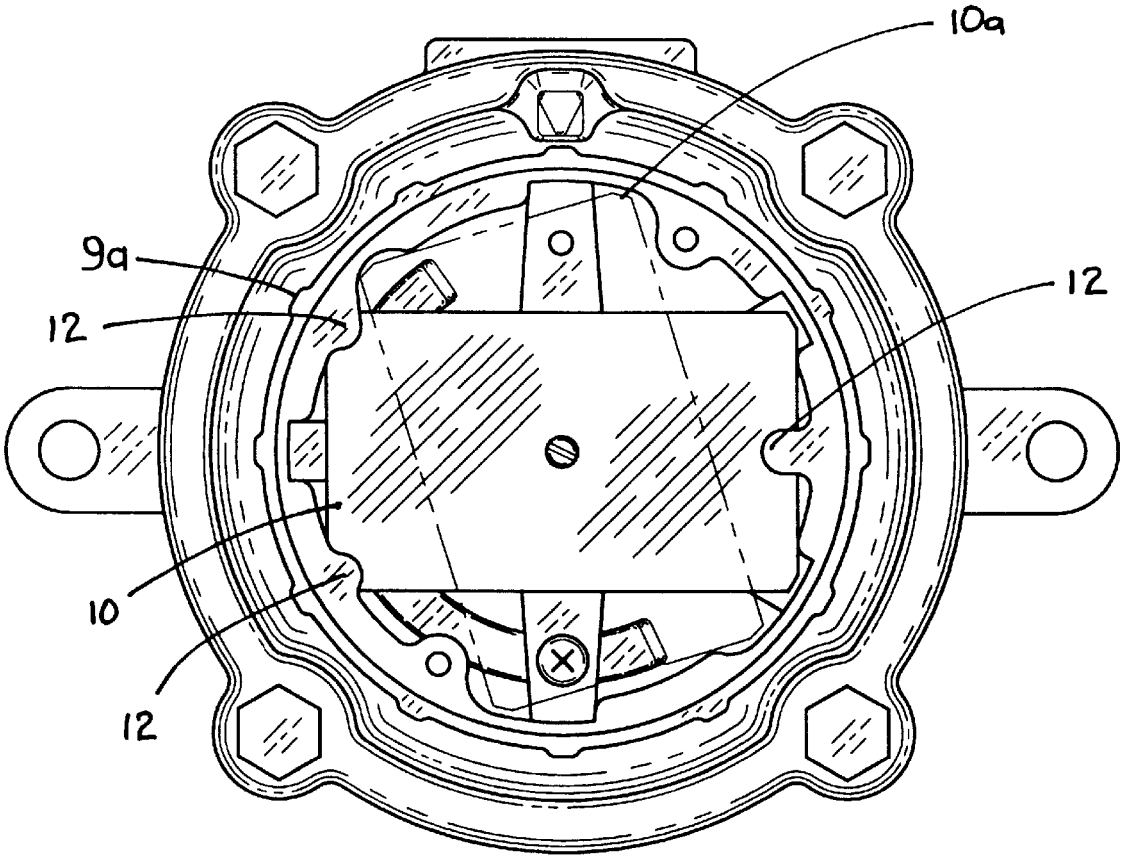
FIG. 4 is a partial cut-away front view of the thermostat of FIG. 2 showing the bimetal plate in both solid and ghost outline.

As shown in FIG. 4 wherein an optional cosmetic cover plate 15 has been removed, the bimetal plate 10 is positioned within the knob 9*a* by first introducing it into the cavity within the knob 9*a* in a rotated ghost position 10*a*. In this rotated position, the plate 10 clears the three contact points provided by the protrusions 12 on the knob 9*a*. Once rotated to its normal position, the plate 10 becomes trapped between these protrusions 12 and the thrust pin 4.

By rotating the adjustment screw 5*a* the thrust pin 4 can be advanced to calibrate the length of travel of the switch plunger 2 in accordance with a scale 16 carried by the cover plate 15 of the knob 9*a*. By rotating the knob 9*a*, the adjustment screw 5*a* and bimetal plate 10 are together displaced towards or away from the thrust pin 4. This consequently varies the degree by which the switch plunger 2 is depressed, causing the switch to be activated when the temperature reaches the setting of the knob 9*a*. Thus, rotation of the knob 9*a* allows the set-point at which the thermostat will "trip" at varying temperatures to be adjusted. And the adjustment screw 5*a* allows this set-point to be calibrated to match the scale 16.

In this manner, the switch 1 is activated by the thermally-induced displacement of the bimetal plate 10 at a temperature selected by rotation of the knob 9*a*.

The center of the bimetal plate 10 is kept in alignment with the pin 4 via the adjustment screw 5*a* which extends from the bimetal plate 10 to which it is fixed, into the recessed hole 13 in the end of the thrust pin 4. Due to the fact that all of the supporting protrusions 12 for the bimetal plate 10 move towards or away from the switch 1 an equal distance during rotation of the knob 9*a*, the angle between the bimetal plate 10 and the switch plunger 2 remains constant. The threaded bushing 11 which supports the adjustment knob 9*a* also acts as a guide for the pin's alignment with the switch plunger 2.

In the exemplary embodiment thermostat of the invention the bimetal sensing element is a plate 10 which is preferably supported via three points or lines of contact on one side, and the thrust pin 4 or switch coupling means 4 on the other side that maintain the plate 10 at a constant angle with respect to the thrust pin 4. This arrangement also allows for minimal friction for the bimetal plate 10 as it bows due to the action of temperature changes.

As the bimetal plate 10 bows in response to changes in temperature, the full action and force of the deflection will act in a direction coincident with the axis of the thrust pin 4.

The calibration screw 5*a* preferably passes through the center and most active part of the bimetal plate 10, and into a hole 13 in the thrust pin 4. This acts to maintain the center of the plate 10 directly in line with the thrust pin 4. There is no tendency for the adjustment screw 5 to slide or move transversely relative to the end of the thrust pin 4.

The use of a bimetal plate having a generally 1:1 aspect ratio, or near this value, preferably in the shape of a square or rectangle, allows greater thrust to be developed at the centre of action than would occur with a narrow strip of similar length. The availability of greater thrust permits the use of a resiliently biased switch plunger that has a stiffer spring rate, making the combined assembly more robust and reliable in terms of accuracy.

In this manner a more desirable form of bimetal thermostat is provided.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive Property are claimed as follows:

1. An electrical thermostat having a body and an electrical switch mounted therein comprising:

(1) a rotatable knob, having contacting supports carried on a face thereof;

(2) a bimetal plate (3) a switch coupling means for activating said electrical switch wherein said bimetal plate is contained by said contacting supports carried by said knob and said switch coupling means for rotation with said knob whereby the set-point of the thermostat may be adjusted by rotation of said knob.

2. A thermostat as in claim 1 wherein the knob is mounted on a threaded bearing for advancement of the bimetal plate towards and away from the switch coupling means.

3. A thermostat as in claim 1 wherein the supports comprise protrusions that contact the bimetal plate at separated points located near the outer periphery of the bimetal plate.

4. A thermostat as in claim 1 further comprising a threaded adjustment screw that is threadably engaged to the bimetal plate in the general area of its maximum deflection for bearing upon the switch coupling means to provide a means for calibration of the thermostat.

5. A thermostat as in claim 4 wherein the adjustment screw penetrates into a recess in the switch coupling means that maintains the adjustment screw and switch coupling means in axial alignment.

6. A thermostat as in claim 2 further comprising a threaded adjustment screw that is threadably engaged to the bimetal plate in the general area of its maximum deflection for bearing upon the switch coupling means to provide a means for calibration of the thermostat.

7. A thermostat as in claim 6 wherein the adjustment screw penetrates into a recess in the switch coupling means that maintains the adjustment screw and switch coupling means in axial alignment.

8. A thermostat as in claim 3 further comprising a threaded adjustment screw that is threadably engaged to the bimetal plate in the general area of its maximum deflection for bearing upon the switch coupling means to provide a means for calibration of the thermostat.

9. A thermostat as in claim 8 wherein the adjustment screw penetrates into a recess in the coupling means that maintains the adjustment screw and coupling means in axial alignment.

* * * * *